US011545755B2

(12) United States Patent
Hankui et al.

(10) Patent No.: US 11,545,755 B2
(45) Date of Patent: Jan. 3, 2023

(54) CONDUCTOR, ANTENNA, AND COMMUNICATION DEVICE

(71) Applicant: JAPAN AVIATION ELECTRONICS INDUSTRY, LIMITED, Tokyo (JP)

(72) Inventors: Eiji Hankui, Tokyo (JP); Hiroshi Toyao, Tokyo (JP); Keishi Kosaka, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 17/050,487

(22) PCT Filed: Apr. 3, 2019

(86) PCT No.: PCT/JP2019/014856

§ 371 (c)(1),
(2) Date: Oct. 26, 2020

(87) PCT Pub. No.: WO2019/208140

PCT Pub. Date: Oct. 31, 2019

(65) Prior Publication Data

US 2021/0075117 A1 Mar. 11, 2021

(30) Foreign Application Priority Data

Apr. 27, 2018 (JP) ..... JP2018-087690

(51) Int. Cl.

| | |
|---|---|
| ***H01Q 13/10*** | (2006.01) |
| ***H01Q 1/38*** | (2006.01) |
| ***H01Q 3/01*** | (2006.01) |
| ***H01Q 9/04*** | (2006.01) |

(52) U.S. Cl.
CPC ..... *H01Q 13/10* (2013.01); *H01Q 1/38* (2013.01); *H01Q 3/01* (2013.01); *H01Q 9/0407* (2013.01)

(58) Field of Classification Search
CPC ..... H01Q 13/10; H01Q 1/38; H01Q 3/01; H01Q 9/0407; H01Q 13/16; H01Q 15/0086
See application file for complete search history.

(56) References Cited

U.S. PATENT DOCUMENTS

| | | | | |
|---|---|---|---|---|
| 8,525,731 | B2 * | 9/2013 | Ju | H01Q 9/42 343/742 |
| 9,070,969 | B2 | 6/2015 | Mow et al. | |
| 9,496,616 | B2 | 11/2016 | Toyao | |
| 9,893,755 | B2 | 2/2018 | Mow et al. | |
| 10,171,125 | B2 | 1/2019 | Mow et al. | |
| 10,218,071 | B2 | 2/2019 | Toyao | |

(Continued)

FOREIGN PATENT DOCUMENTS

| | | | |
|---|---|---|---|
| JP | 2018129595 | A | 8/2018 |
| KR | 20110060717 | A | 6/2011 |

(Continued)

OTHER PUBLICATIONS

Paul, SRR Loaded Slot Antenna for Multiband Application, 2017, pp. 2529-2530 (Year: 2017).*

(Continued)

*Primary Examiner* — David E Lotter
(74) *Attorney, Agent, or Firm* — Holtz, Holtz & Volek PC

(57) ABSTRACT

Provided is a conductor, for example, equipped with a split-ring resonator, and an opening, wherein a split in the split-ring resonator and the opening are spatially continuous.

8 Claims, 14 Drawing Sheets

(56) References Cited

U.S. PATENT DOCUMENTS

| | | | | |
|---|---|---|---|---|
| 2008/0272972 | A1 | 11/2008 | Kanno et al. | |
| 2014/0203993 | A1* | 7/2014 | Toyao | H01P 5/107 343/867 |
| 2017/0040689 | A1* | 2/2017 | Toyao | H01Q 7/00 |
| 2018/0123261 | A1* | 5/2018 | Sano | H01Q 9/0442 |
| 2018/0234072 | A1* | 8/2018 | Kuo | H01Q 1/48 |
| 2018/0287268 | A1* | 10/2018 | Kosaka | H01Q 21/061 |

FOREIGN PATENT DOCUMENTS

| | | | |
|---|---|---|---|
| KR | 20120004338 | A | 1/2012 |
| WO | 2013027824 | A1 | 2/2013 |

OTHER PUBLICATIONS

Korean Office Action dated Sep. 25, 2021 (and English translation thereof) issued in Korean Application No. 10-2020-7030850.

Extended European Search Report (EESR) dated Apr. 9, 2021 issued in counterpart European Application No. 19793197.5.

Chen, et al., "Miniaturized Design of Microstrip-Fed Slot Antennas Loaded With C-Shaped Rings", IEEE Antennas and Wireless Propagation Letters, Mar. 17, 2011, pp. 203-206.

Mizra, et al., "A study of loop antenna miniaturization using split ring resonators", IEEE APS, Jun. 9, 2007, pp. 1865-1868.

Sarkar, et al., "Multi-band microstrip-fed slot antenna loaded with split-ring resonator", Electronics Letters, Oct. 9, 2014, pp. 1498-1500.

Tirkey, et al., "Design of flexible meandered loop antennas loaded with CSRR and SRR for implantable applications", International Conference WISPNET, Mar. 23, 2016, pp. 1595-1598.

Paul, Princy et al., "SRR loaded slot antenna for multiband applications", 2017 IEEE International Symposium on Antennas and Propagation & USNC/URSI National Radio Science Meeting, 2017, pp. 2529-2530.

International Search Report (ISR) (and English translation thereof) dated May 28, 2019 issued in International Application No. PCT/JP2019/014856.

Written Opinion dated May 28, 2019 issued in International Application No. PCT/JP2019/014856.

Taiwanese Office Action (and English language translation thereof) dated Jul. 4, 2022, issued in counterpart Taiwanese Application No. 108112231.

Japanese Office Action (and English language translation thereof) dated Oct. 5, 2022, issued in counterpart Japanese Application No. 2020-516166.

* cited by examiner

CONDUCTOR, ANTENNA, AND COMMUNICATION DEVICE

TECHNICAL FIELD

This invention relates to, for example, a conductor, an antenna and a communication device.

BACKGROUND ART

An antenna formed of a split-ring resonator is known as a small antenna used in a communication device.

For example, Patent Document 1 discloses a communication device provided with an antenna formed of a split-ring resonator.

PRIOR ART DOCUMENTS

Patent Document(s)

Patent Document 1: WO 2013/027824

SUMMARY OF INVENTION

Technical Problem

In the aspect of Patent Document 1, the split-ring resonator is hard to be arranged, for example, at a place other than an edge of a conductor.

Solution to Problem

For example, a conductor according to an aspect of the present disclosure may be provided with a split-ring resonator and an opening, and a split in the split-ring resonator and the opening may be spatially continuous to each other.

Advantageous Effects of Invention

According to an aspect of the present disclosure, a split-ring resonator can be arranged, for example, at a place other than an edge of a conductor.

DESCRIPTION OF EMBODIMENTS

All aspects in the present disclosure are merely illustrative and not intended to exclude other examples from the present disclosure or limit the technical scope of the claimed invention.

There may be a case that the description is omitted in part about combinations of aspects in the present disclosure.

The omission is intended to simplify the description but not intended to exclude the combinations or limit the technical scope of the claimed invention.

All combinations of aspects in the present disclosure are explicitly, suggestively or intrinsically included in the present disclosure, regardless of whether the omission is made or not.

In other words, all combinations of aspects in the present disclosure can be directly and clearly lead from the present disclosure, regardless of whether the omission is made or not.

For example, a conductor 1 according to an aspect of the present disclosure may be provided with a split-ring resonator 12 and an opening 13, and a split 121 of the split-ring resonator 12 and the opening 13 may be spatially continuous with each other.

Figure 1:
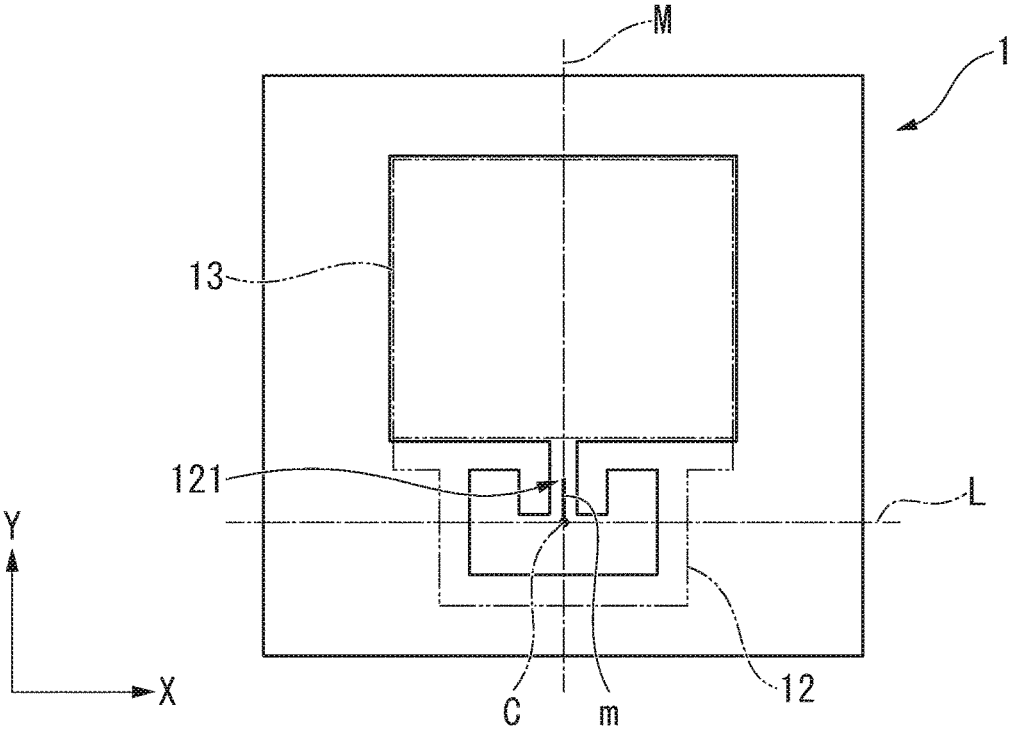
FIG. 1 is a plan view of an example of a conductor according to an aspect of the present disclosure.

FIG. 1 is a plan view of an example of a conductor 1 according to an aspect of the present disclosure.

Figure 2:
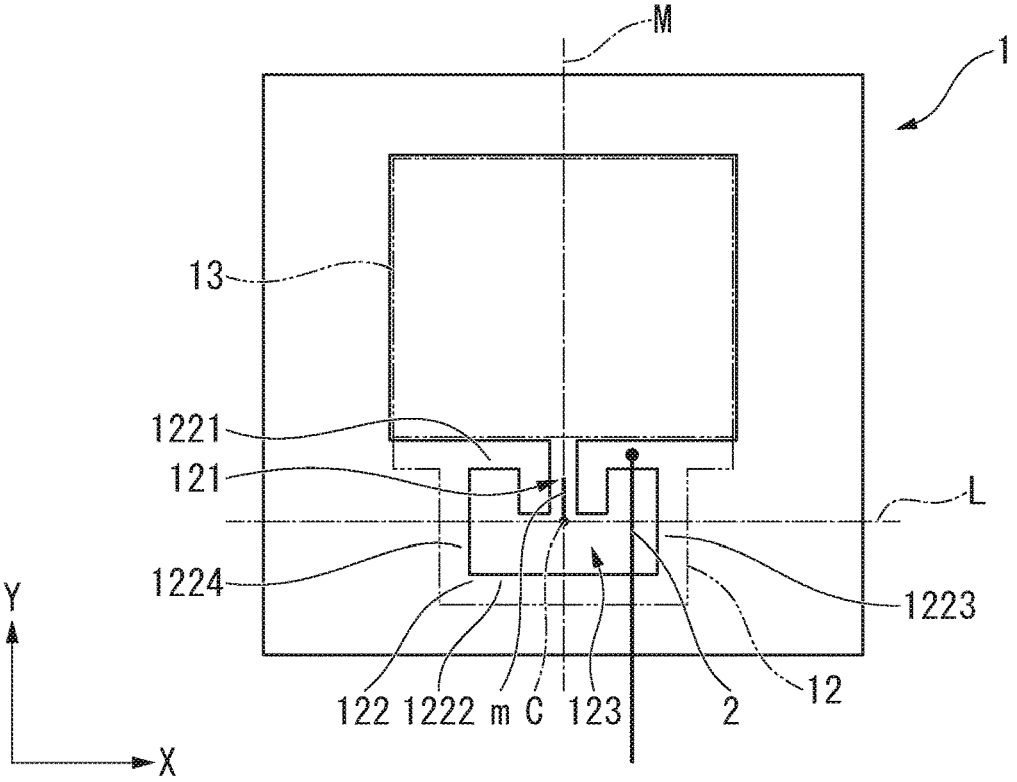
FIG. 2 is a plan view of an example of a conductor according to an aspect of the present disclosure.

FIG. 2 is a plan view of an example of a conductor 1 according to an aspect of the present disclosure.

For example, a center of a ring in a split-ring resonator 12 will be referred to as a point C.

For example, a line segment which connects a split of the split-ring resonator 12 and the point C to each other will be referred to as a line segment m.

For example, a straight-line which is obtained by extending the line segment m will be referred to as a straight-line M.

For example, a straight-line which is perpendicular to the straight-line M and passes through the point C will be referred to as a straight-line L. Thus, on the straight-line L, the point C exists.

For example, a direction in which the straight-line M extends will be referred to as a Y-axis direction.

For example, a direction in which the straight-line L extends will be referred to as an X-axis direction.

For example, the conductor 1 may be made of a conductive pattern, a sheet metal, etc.

For example, the split-ring resonator 12 may be provided with a split 121, a split-ring 122 and a ring-inner opening 123.

For example, the split-ring 122 may have a shape based on an approximately C-shape along a rectangular-ring which is provided with a first conductor 1221 extending in the X-axis direction and continued across the split 121, a second conductor 1222 extending in the X-axis direction, a third conductor 1223 extending in the Y-axis direction and a fourth conductor 1224 extending in the Y-axis direction.

For example, the split-ring 122 may has any shape or a shape based on a shape extending along one of various rings, such as a circular ring, an oval ring, a track-shaped ring etc.

For example, parts of the first conductor 1221 which sandwich the split 121 may extend in the Y-axis direction or not.

For example, the ring-inner opening 123 may be surrounded by the split 121 and the split-ring 122.

For example, the opening 13 may be adjacent to the split 121 and the first conductor 1221.

For example, a length of the opening 13 in the X-axis direction may be longer than a length of the split 121 in the X-axis direction.

For example, the opening 13 may have any shape, such as a polygon including a square, a rectangle, etc., a circle, an oval, etc.

For example, a feeder 2 may be connected to the conductor 1.

For example, a first end of the feeder 2 may be connected to the conductor 1.

For example, the first end of the feeder 2 may be connected to the split-ring 122.

For example, the first end of the feeder 2 may be connected to the first conductor 1221.

For example, a second end of the feeder 2 may extend across the ring-inner opening 123 and the second conductor 1222 when viewed from the first end of the feeder 2.

For example, the feeder 2 may be an electrical wire for feeding an RF (Radio Frequency) signal.

For example, the second end of the feeder 2 may be supplied with the RF signal.

For example, the feeder 2 may be made of a lead line, a sheet metal, etc.

Figure 3:
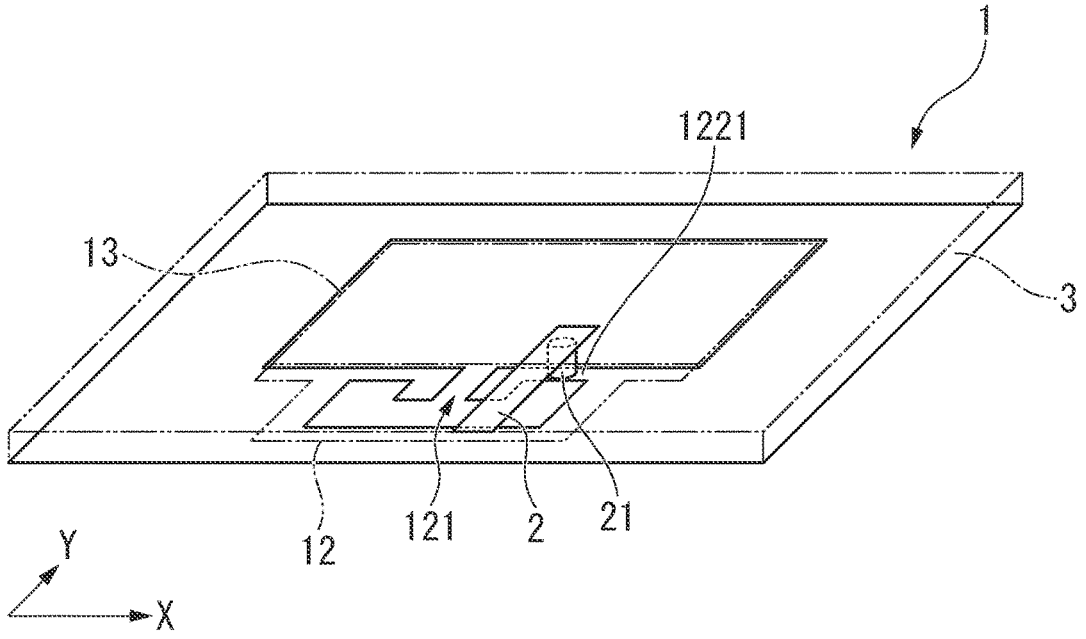
FIG. 3 is a perspective view of an example of a conductor according to an aspect of the present disclosure.

FIG. 3 is a perspective view of an example of a conductor according to an aspect of the present disclosure.

For example, a conductor 1 may be provided on one of both plate surfaces of a substrate 3.

For example, the substrate 3 may be made of a glass epoxy substrate, a ceramics substrate, a resin substrate, a glass substrate, etc.

For example, a feeder 2 may be connected to a first conductor 1221 through a via 21 piercing between the both plate surfaces of the substrate 3.

For example, the feeder 2 may be provided on one of the both plate surfaces of the substrate 3 on which the conductor 1 is not provided.

Figure 4:
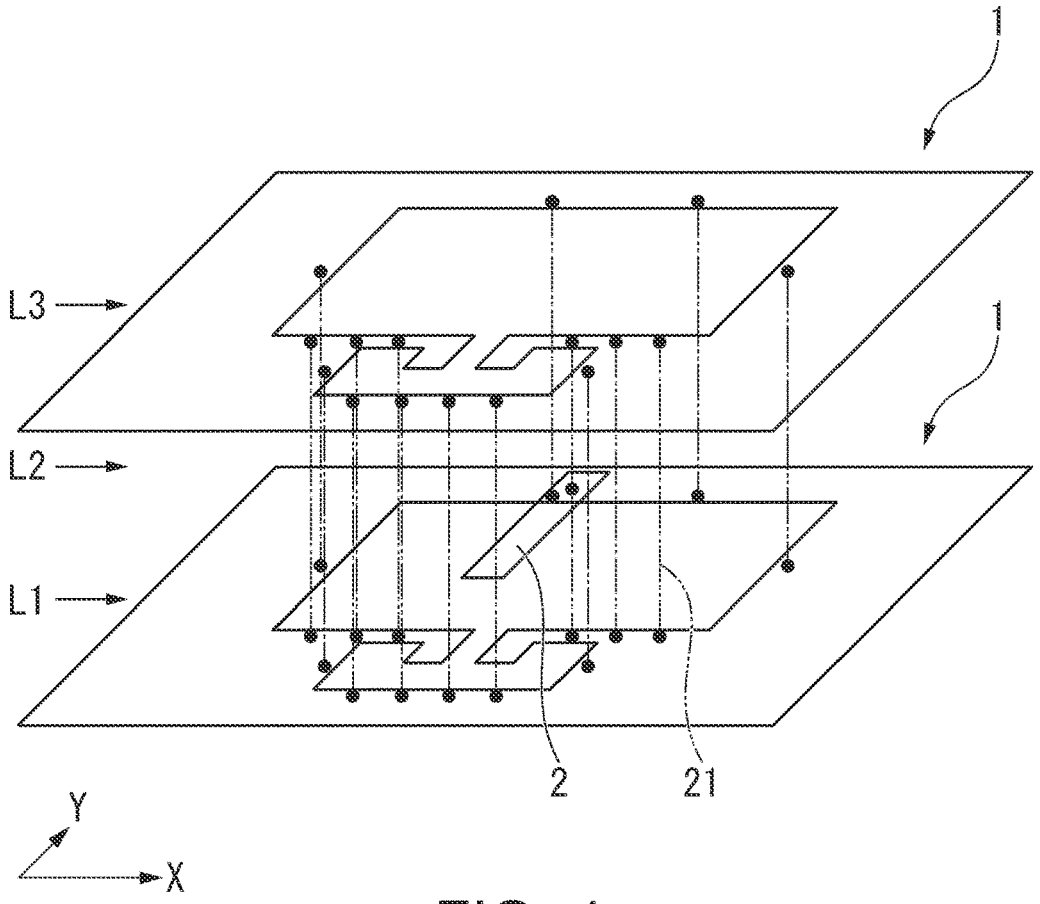
FIG. 4 is an exploded view of an example of a conductor according to an aspect of the present disclosure.

FIG. 4 is an exploded view of an example of a conductor according to an aspect of the present disclosure.

For example, a conductor 1 may employ single-layer structure or multilayer structure.

For example, when the conductor 1 employs two-layer structure, for layers in which a first layer L1, a second layer L2 and a third layer L3 are laminated in this order, the first layer L1 may be provided with a conductor 1, the third layer L3 may be provided with another conductor 1, and the second layer L2 may be provided with a feeder 2.

For example, the conductor 1 in the first layer L1, the conductor 1 in the third layer L3 and the feeder 2 may be connected to one another though vias 21.

Figure 5:
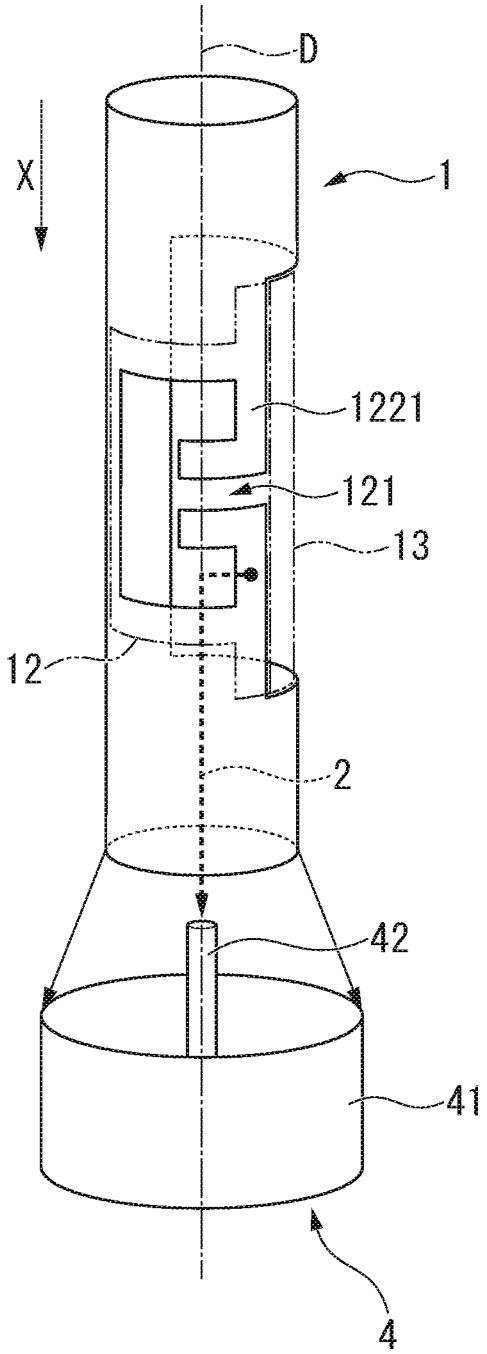
FIG. 5 is a perspective view of an example of a conductor according to an aspect of the present disclosure.

FIG. 5 is a perspective view of an example of a conductor according to an aspect of the present disclosure.

For example, a conductor 1 may have a cylindrical shape with a cylindrical axis direction D directed in the X-axis direction.

For example, the conductor 1 may be connected to a connector 4 at one end side thereof in the cylindrical axis direction D.

For example, the connector 4 may be provided with a peripheral conductor 41 and an internal axis conductor 42.

For example, the one end side of the conductor 1 in the cylindrical axis direction D may be connected to the peripheral conductor 41, and a first conductor 1221 may be connected to the inner axis conductor 42 through a feeder 2.

For example, the one end side of the conductor 1 in the cylindrical axis direction D may be directly connected to the peripheral conductor 41 or may be connected to it through something, such as a lead line or a sheet metal.

Figure 6:
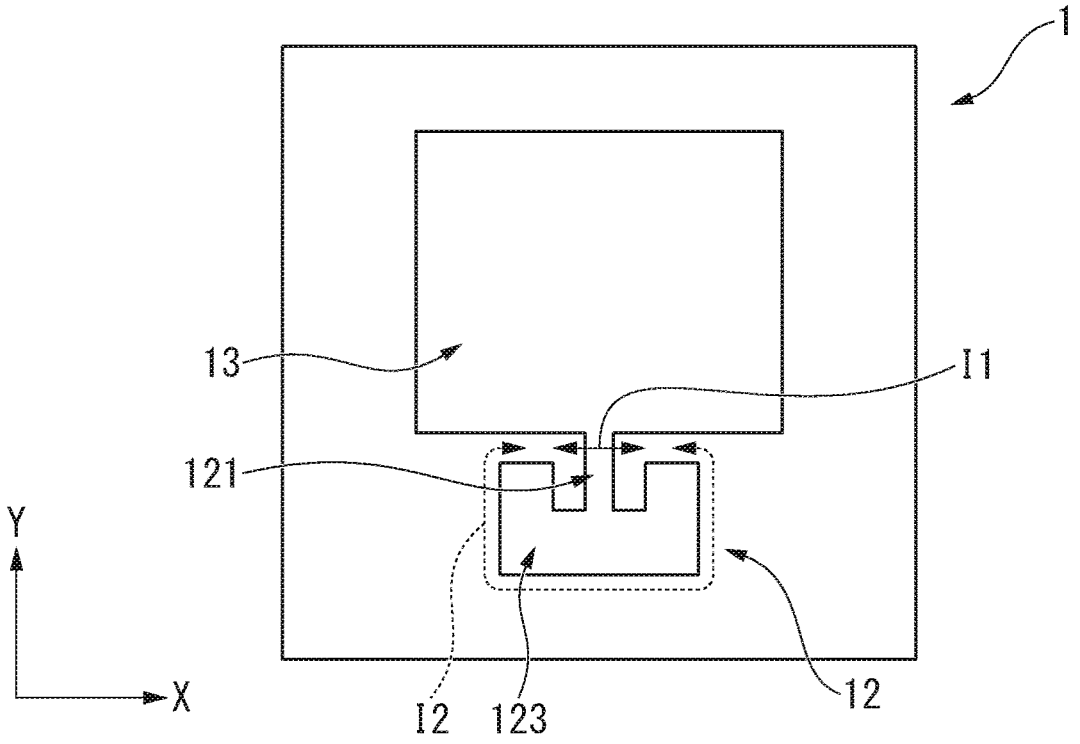
FIG. 6 shows an example of currents flowing in an example of a conductor according to an aspect of the present disclosure.

FIG. 6 shows an example of currents in an example of a conductor according to an aspect of the present disclosure.

For example, supposing a split-ring resonator is simply arranged at a place other than an edge of a conductor, a split of the split-ring resonator is short-circuited by a nearby conductor. Accordingly, a current becomes hard to pass through the split, and the split-ring resonator is possible not to work as an antenna.

In contrast, for example, a conductor 1 according to an aspect of the present disclosure may be provided with a split-ring resonator 12 and an opening 13, and a split 121 of the split-ring resonator 12 and the opening 13 may be spatially continuous with each other.

Accordingly, for example, the conductor 1 according to an aspect of the present disclosure can produce a current I1 in the split 121 and the vicinity of the split 121 in the X-axis direction and a current I2 along the ring-inner opening 123, and radiate an RF signal efficiently.

Therefore, according to an aspect of the present disclosure, a split-ring resonator can be arranged, for example, at a place other than an edge of the conductor.

For example, a conductor according to an aspect of the present disclosure (e.g. the conductor 1 or the like) may be provided with a control unit 14, and the control unit 14 may be configured to control a size of the opening 13.

Figure 7:
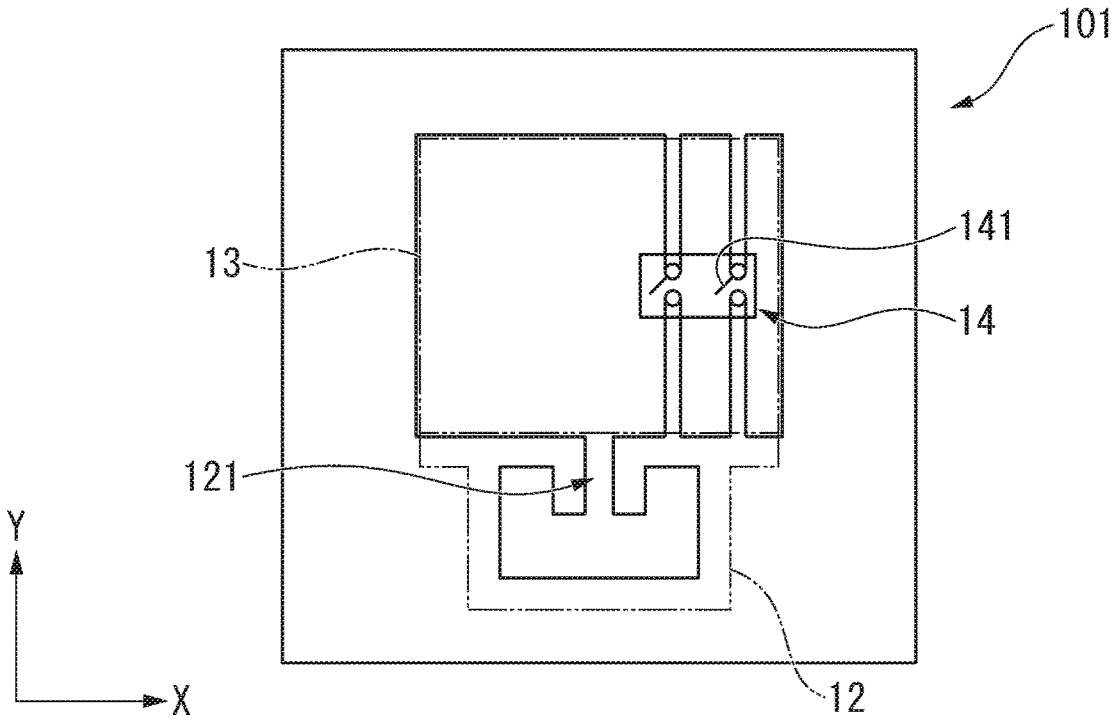
FIG. 7 is a plan view of an example of a conductor according to an aspect of the present disclosure.

FIG. 7 is a plan view of an example of a conductor according to an aspect of the present disclosure.

For example, a control unit 14 may be provided with switches 141. In that case, by turning each of the switches 141 on or off, a conductor 101 may be electrically opened or short-circuited between positions which are aligned in the Y-axis direction to sandwich the opening 13.

For example, conductive patterns may extend from a periphery of the opening 13 to each of the switches 141.

Although FIG. 7 shows two of the switches 141 as the control unit 14, the number of the switch(es) 141 may be one or three or more.

The control unit 14 shown in FIG. 7 short-circuits the positions aligned in the Y-axis direction. However, the control unit 14 may short-circuit any positions, provided that it is configured to control the size of the opening 13. For example, the control unit 14 may short-circuit the conductor 101 at positions aligned in the X-axis direction.

The control unit 14 shown in FIG. 7 short-circuits the conductor 101. However, the control unit 14 may short-circuit the conductor 101 in any way, provided that it is configured to control the size of the opening 13. For example, the control unit 14 may electrically connect positions sandwiching the opening 13 and aligned in the Y-axis direction through an impedance element.

FIG. 7 shows the switches 141 as the control unit 14. However, any unit may be provided, provided that it is configured to control the size of the opening 13.

For example, a jumper line may be provided as the control unit 14 between positions sandwiching the opening 13 in the conductor 101. In that case, the size of the opening 13 may be controlled by short-circuiting the conductor 101 with the jumper line.

For example, a short-circuit pattern may be previously provided as the control unit 14 between positions sandwiching the opening 13 in the conductor 101. In that case, the size of the opening 13 may be controlled by cutting the short-circuit pattern.

Since the control unit 14 is configured to control the size of the opening 13 in the conductor 101 according to an aspect of the present disclosure, frequency characteristics of a split-ring resonator 12 can be controlled.

In the conductor 101, besides a current I1 and a current I2, a current is caused around the opening 13. These currents have an influence on the frequency characteristics of the split-ring resonator 12. Accordingly, controlling the size of the opening 13 allow control the frequency characteristics of the split-ring resonator 12.

If the frequency characteristics of the split-ring resonator 12 can be controlled, frequency characteristics of return loss of the split-ring resonator 12 can be controlled. Accordingly, for example, when the split-ring resonator 12 is applied to a radiation antenna, the conductor 101 can control radiation characteristics of the split-ring resonator 12.

For example, in a conductor according to an aspect of the present disclosure (e.g. the conductor 1, the conductor 101, or the like), an opening 13 may have an elongated shape.

Figure 8:
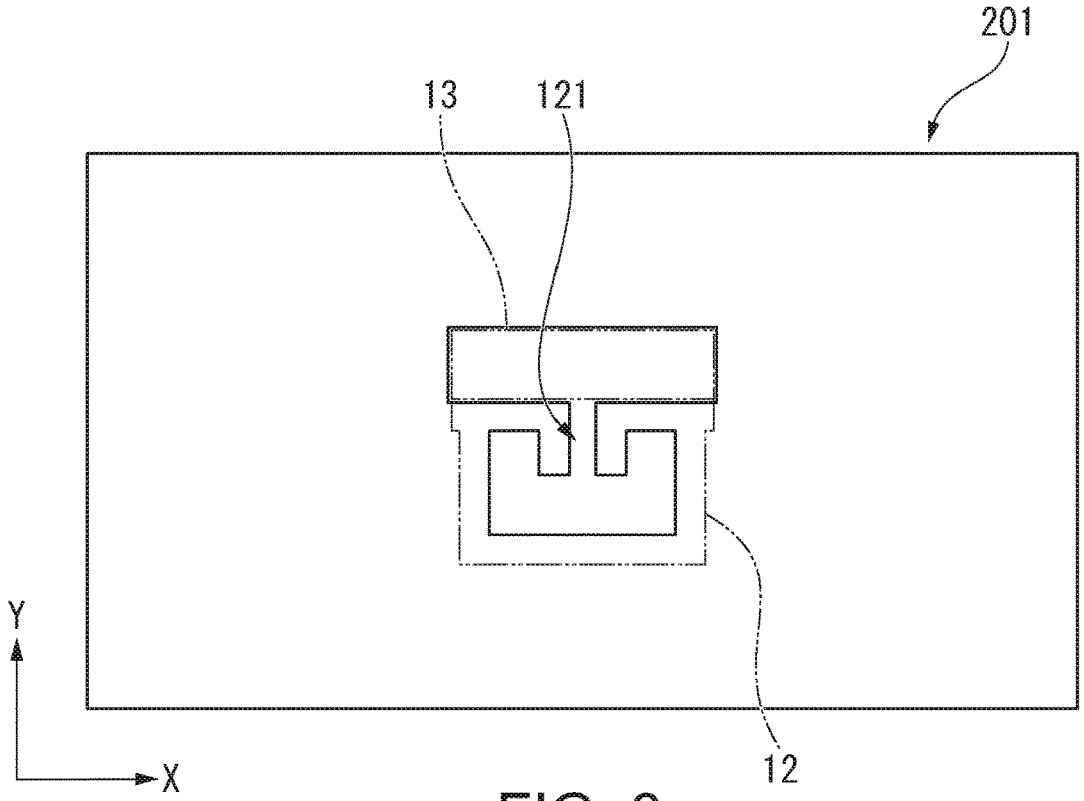
FIG. 8 is a plan view of an example of a conductor according to an aspect of the present disclosure.

FIG. 8 is a plan view of an example of a conductor according to an aspect of the present disclosure.

For example, an opening 13 may have an elongated shape which is long in the X-axis direction in comparison with in Y-axis direction.

Although the opening 13 is elongated in the X-axis direction in FIG. 8, the opening 13 may be elongated in any direction.

For example, the opening 13 may be elongated in the Y-axis direction or may be elongated in a direction inclined with respect to the X-axis direction.

For example, the opening 13 may be elongated in the X-axis direction and, from one end thereof, be further elongated in the Y-axis direction.

For example, the opening 13 may be elongated in the Y-axis direction and, from one end thereof, be further elongated in the X-axis direction.

For example, the opening 13 may be elongated and, from one end thereof, be further branched and elongated.

Figure 9:
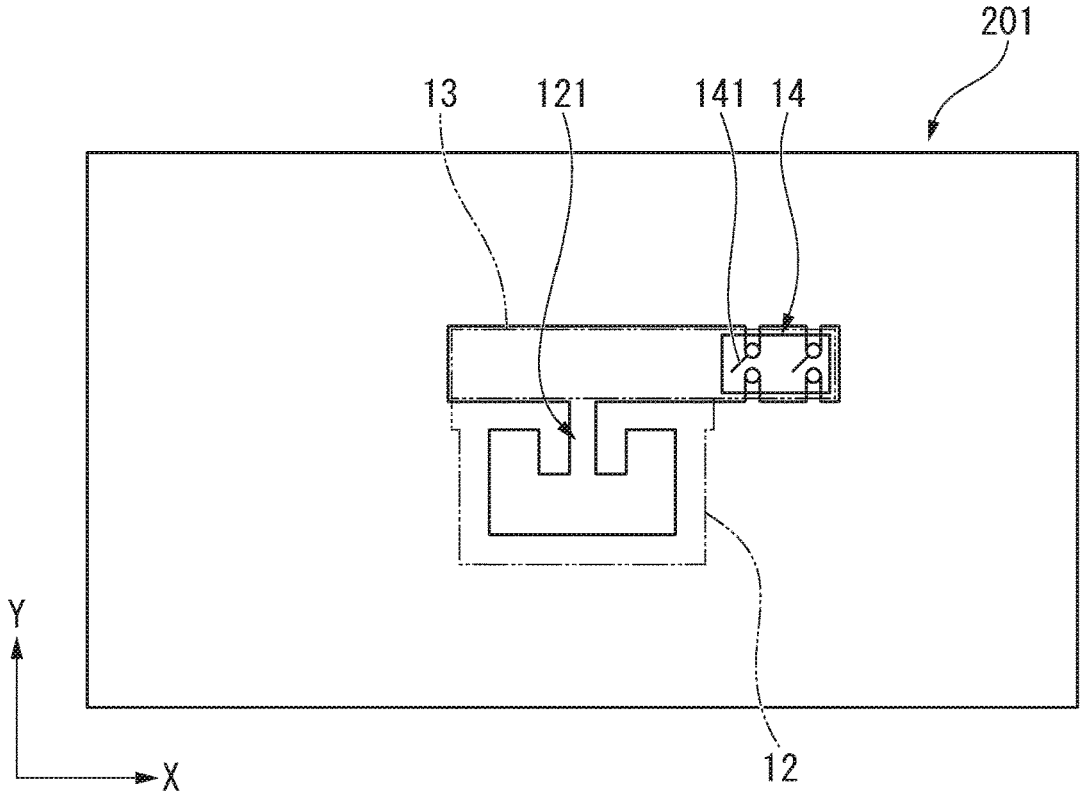
FIG. 9 is a plan view of an example of a conductor according to an aspect of the present disclosure.

FIG. 9 is a plan view of an example of a conductor according to an aspect of the present disclosure.

For example, a conductor 201 may be provided with a control unit 14 which is configured to control a size of an opening 13.

Since an opening 13 has an elongated shape in a conductor 201 according to an aspect of the present disclosure, the conductor 201 is easy to secure a space for putting other parts in the vicinity of the opening 13.

As mentioned above, the current caused around the opening 13 has an influence on frequency characteristics of a split-ring resonator 12. Accordingly, the opening 13 must have a periphery length with a certain length.

For example, when an elongated-shape opening and a square-shape opening which have the same periphery length are compared, an area of the elongated-shape opening is smaller than an area of the square-shape opening.

Accordingly, employing the elongated shape can reduce an area occupied by the opening 13 in the conductor 201 in comparison with employing the square shape.

Therefore, by employing the elongated shape for the opening 13, the conductor 201 can be easy to secure a space for putting other parts in the vicinity of the opening 13.

For example, in a conductor according to an aspect of the present disclosure (e.g. the conductor 201 or the like), a length of an opening 13 in a direction which is approximately parallel to a tangential line between a split-ring resonator 12 and the opening 13 may be longer than a length of the opening 13 in a direction approximately perpendicular to the tangential line between the split-ring resonator 12 and the opening 13.

Figure 10:
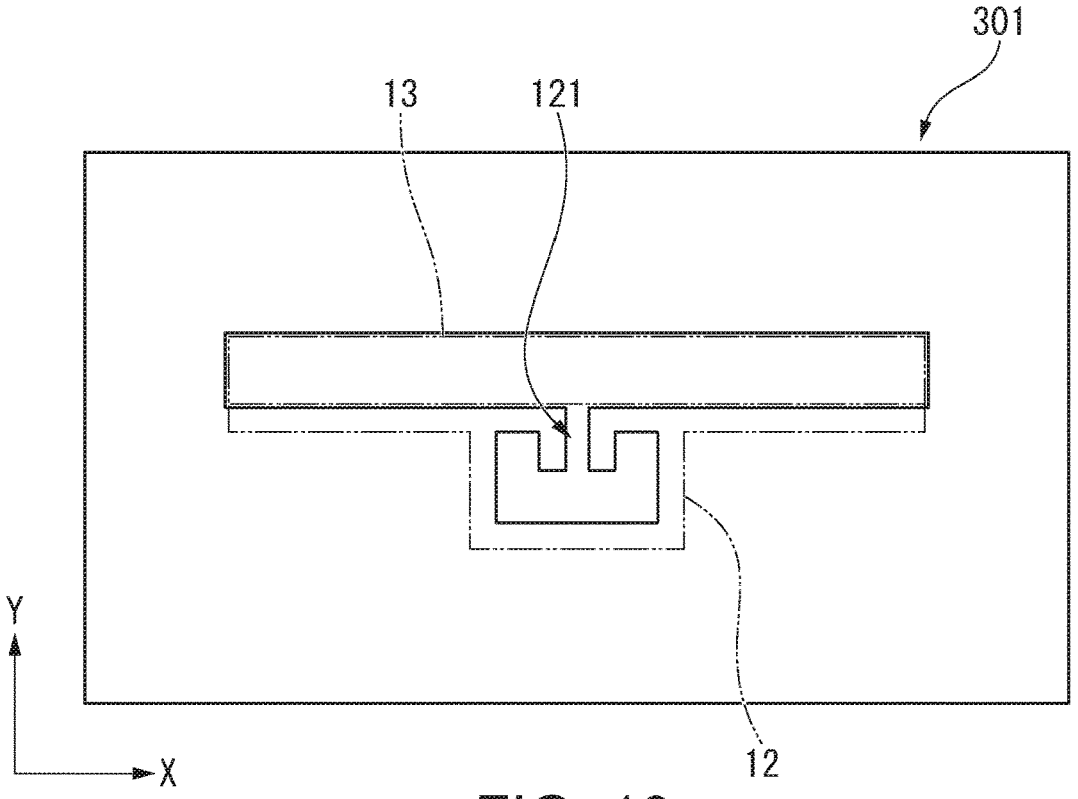
FIG. 10 is a plan view of an example of a conductor according to an aspect of the present disclosure.

FIG. 10 is a plan view of an example of a conductor according to an aspect of the present disclosure.

For example, a direction of an opening 13 that is approximately parallel to a tangential line between a split-ring resonator 12 and the opening 13 may correspond to the X-axis direction, and a direction of the opening 13 that is approximately perpendicular to the tangential line between the split-ring resonator 12 and the opening 13 may correspond to the Y-axis direction. In that case, the length of the opening 13 in the X-axis direction may be longer than the length of the opening 13 in the Y-axis direction.

For example, the opening 13 may have an elongated shape extending long in the X-axis direction in comparison with the split-ring resonator 12.

For example, the opening 13 may have an elongated shape extending long in both sides in the X-axis direction in comparison with the split-ring resonator 12.

Figure 11:
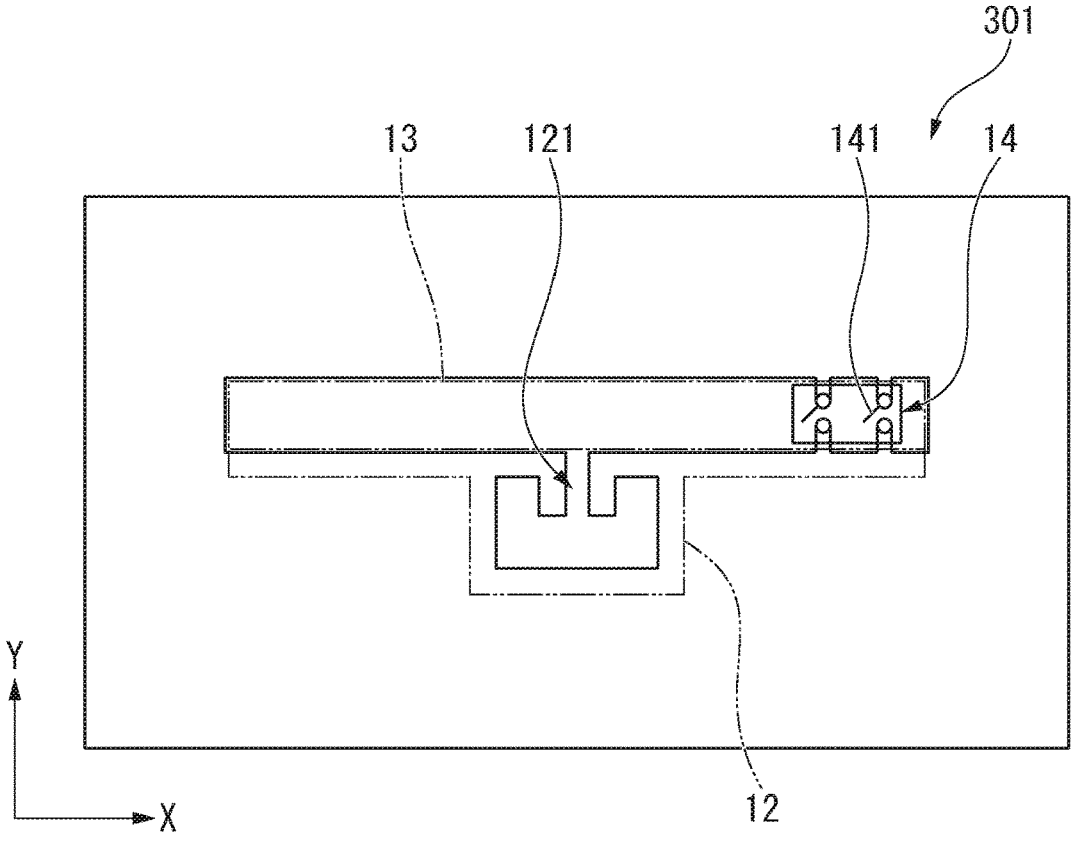
FIG. 11 is a plan view of an example of a conductor according to an aspect of the present disclosure.
Figure 12:
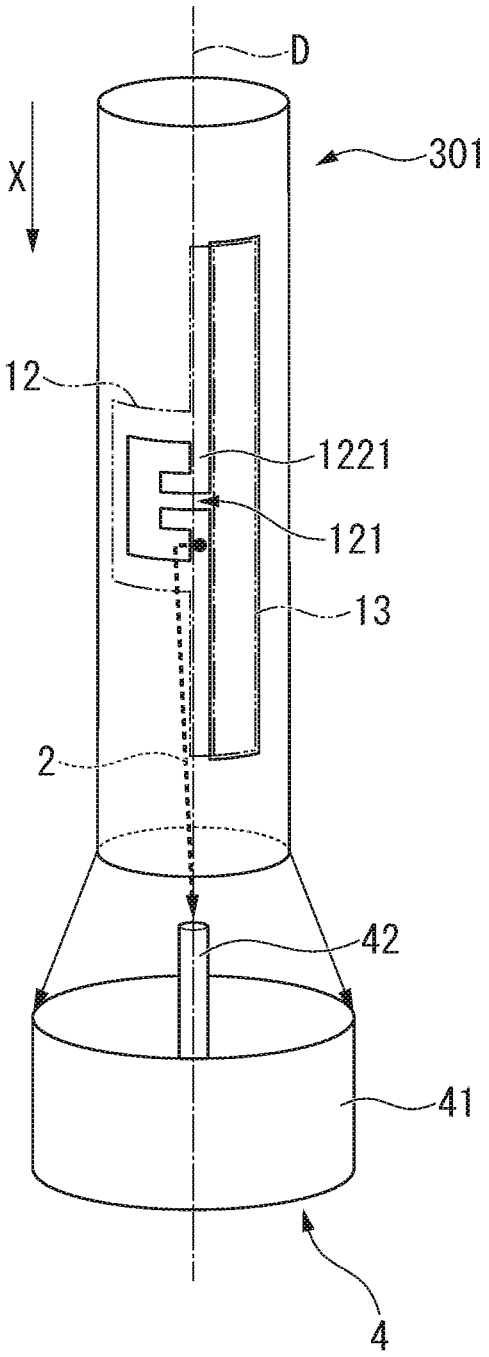
FIG. 12 is a perspective view of an example of a conductor according to an aspect of the present disclosure.

FIG. 11 is a plan view of an example of a conductor according to an aspect of the present disclosure.

For example, a conductor 301 may be provided with a control unit 14 which is configured to control a size of an opening 13.

For example, the control unit 14 may be provided with switches 141. In that case, by turning each of the switches 141 on or off, the conductor 301 may be electrically opened or short-circuited between positions which are aligned in the Y-axis direction to sandwich the opening 13.

Fig. is a perspective view of an example of a conductor according to an aspect of the present disclosure.

For example, a conductor 301 may have a cylindrical shape with a cylindrical axis direction D directed in the X-axis direction.

For example, the conductor 301 may be connected to a connector 4 at one end side thereof in the cylindrical axis direction D.

For example, the connector 4 may be provided with a peripheral conductor 41 and an internal axis conductor 42.

For example, the one end side of the conductor 301 in the cylindrical axis direction D may be connected to the peripheral conductor 41, and a first conductor 1221 may be connected to the inner axis conductor 42 through a feeder 2.

For example, the one end side of the conductor 301 in the cylindrical axis direction D may be directly connected to the peripheral conductor 41 or may be connected to it through something, such as a lead line or a sheet metal.

According to a conductor 301 according to an aspect of the present disclosure, a length of an opening 13 in a direction approximately parallel to a tangential line between a split-ring resonator 12 and the opening 13 is long. Therefore, the conductor 301 is easy to secure a space for putting other parts in the vicinity of the opening 13.

In order to generate a current I1 in a split 121 of the split-ring resonator, the length of the opening 13 in the direction approximately parallel to the tangential line between the split-ring resonator 12 and the opening 13 needs a certain length.

For example, when an elongated opening and a square opening, which are the same in length in a direction approximately parallel to a tangential line between a split-ring resonator and the opening, are compared, an area of the elongated opening is smaller than an area of the square opening.

Accordingly, employing the elongated shape can reduce an area occupied by the opening in the conductor in comparison with employing the square shape.

Therefore, by employing an elongated shape for the opening 13 so that a length of the opening 13 is long in a direction approximately parallel to a tangential line between the split-ring resonator 12 and the opening 13, the conductor 301 is easy to secure a space for putting other parts in the vicinity of the opening 13.

For example, in a conductor according to an aspect of the present disclosure (e.g. the conductor 201 or the like), a length of an opening 13 in a direction approximately parallel to a tangential line between a split-ring resonator 12 and the opening 13 may be shorter than a length of the opening 13 in a direction approximately perpendicular to the tangential line between the split-ring resonator 12 and the opening 13.

Figure 13:
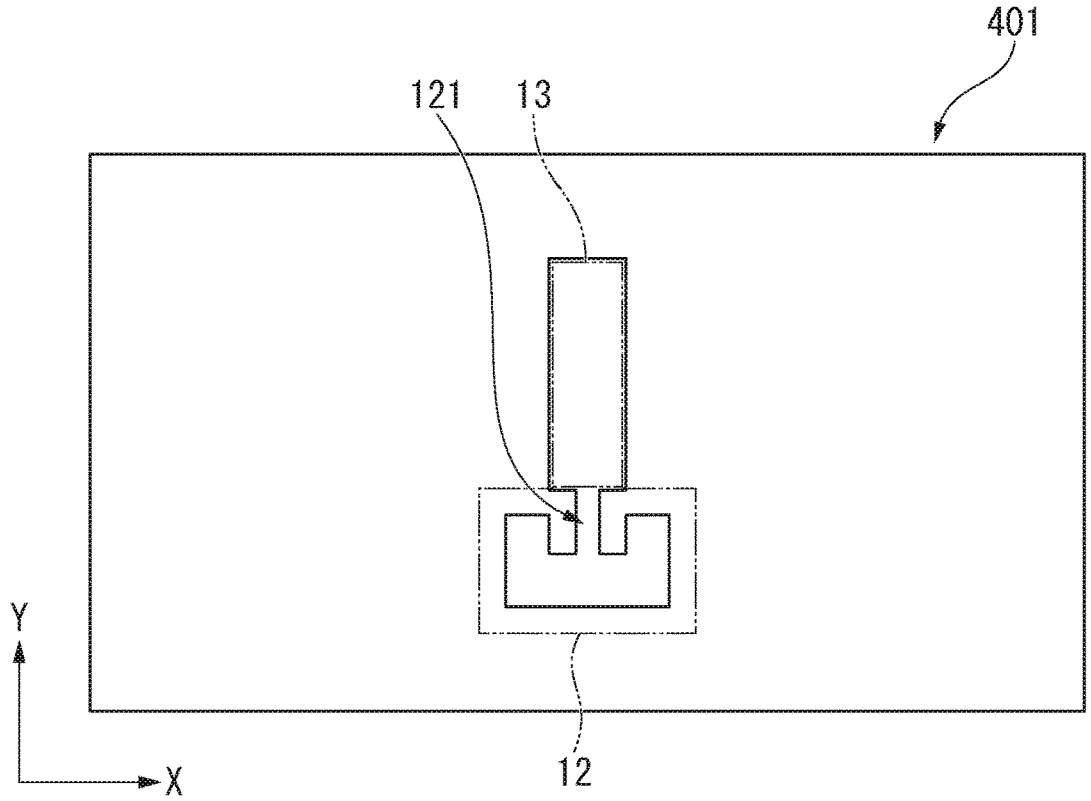
FIG. 13 is a plan view of an example of a conductor according to an aspect of the present disclosure.

FIG. 13 is a plan view of an example of a conductor according to an aspect of the present disclosure.

For example, a length of an opening 13 in the X-direction may be shorter than a length of the opening 13 in the Y-direction.

For example, the opening 13 may have an elongated shape which extends in the Y-direction and is longer than a split-ring resonator 12.

For example, the opening 13 may has an elongated shape extending in Y-direction from the vicinities of both outer sides of a split 121 in the X-direction.

Figure 14:
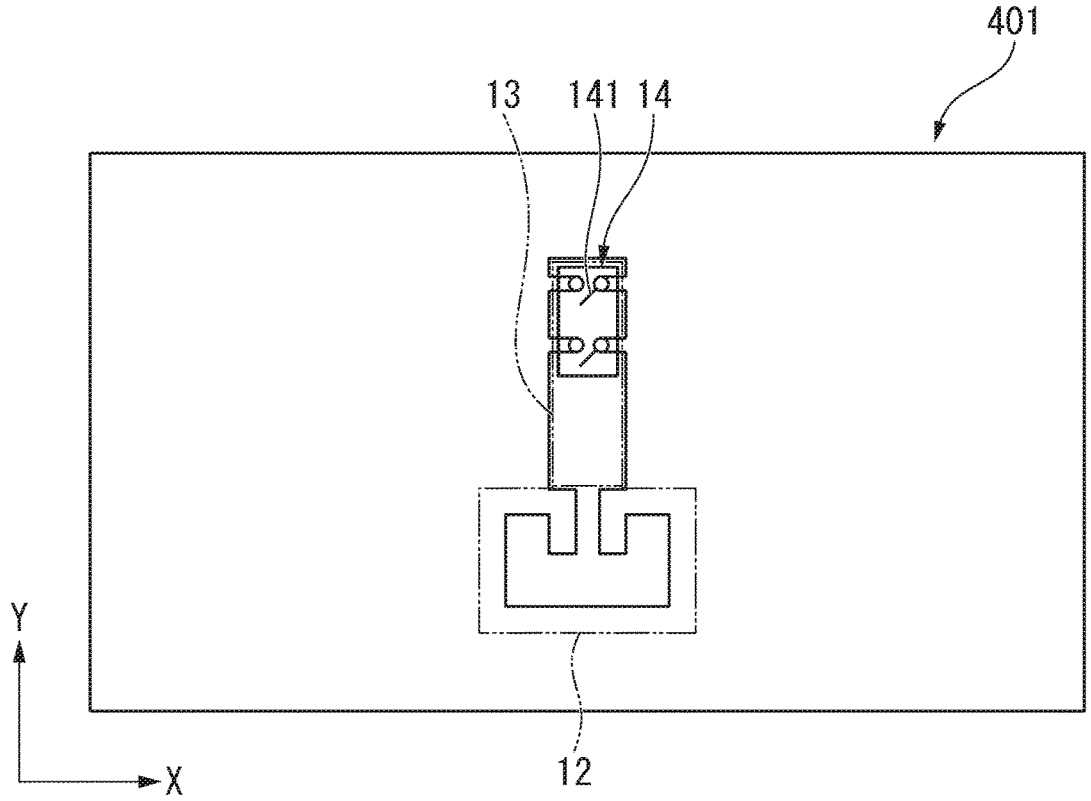
FIG. 14 is a plan view of an example of a conductor according to an aspect of the present disclosure.

FIG. 14 is a plan view of an example of a conductor according to an aspect of the present disclosure.

For example, a conductor 401 may have a control unit 14 configured to control a size of an opening 13.

Figure 15:
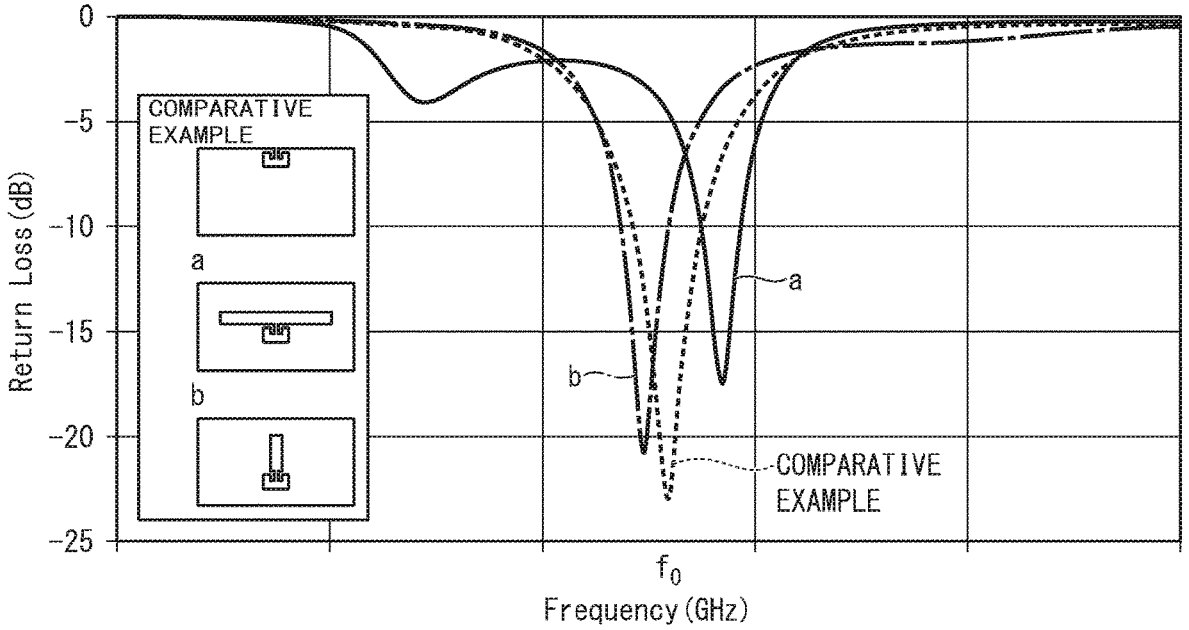
FIG. 15 shows an example of return loss characteristics of examples of split-ring resonators according to some aspects of the present disclosure.

FIG. 15 shows examples of return loss characteristics of examples of split-ring resonators according to aspects of the present disclosure.

A curve a is a return loss curve of the split-ring resonator 12 in the conductor 301 according to FIG. 10.

A curve b is a return loss curve of the split-ring resonator 12 in the conductor 401 according to FIG. 13.

As a comparative example, a return loss curve of a split-ring resonator 12 is shown in a case where a conductor is not provided with an opening 13 and the split-ring resonator 12 is arranged on an edge of a conductor.

As shown in FIG. 15, reflection loss at the resonance frequency of the split ring resonator 12 in the curve b is smaller than that in the curve a around a frequency fo.

In particular, the return loss characteristics of the curve b is closer to the return loss characteristics of the comparative example, in which the split-ring resonator 12 is arranged at the edge of the conductor, in comparison with the return loss characteristics of the curve a.

In other words, according to a conductor 401 according to an aspect of the present disclosure, a length of an opening 13 in a direction approximately parallel to a tangential line between a split-ring resonator 12 and the opening 13 is short, and thus the conductor 401 can make the return loss characteristics smaller.

It should be noted that, as shown in FIG. 15, the resonance frequency of the curve a and the resonance frequency of the curve b are different from each other. Specifically, the resonance frequency of the curve b is smaller than the resonance frequency of the curve a. That is, by adjusting the relationship between the length of the opening 13 in the direction approximately parallel to the tangential line between the split-ring resonator 12 and the opening 13 and a length of the opening 13 in a direction approximately perpendicular to the tangential line between the split-ring resonator 12 and the opening 13, the resonance frequency of the split-ring resonator 12 can be controlled.

For example, a conductor according to an aspect of the present disclosure (e.g. the conductor 1, the conductor 101, the conductor 201, the conductor 301, the conductor 401, or the like) may be provided with a plurality of split-ring resonators 12.

Figure 16:
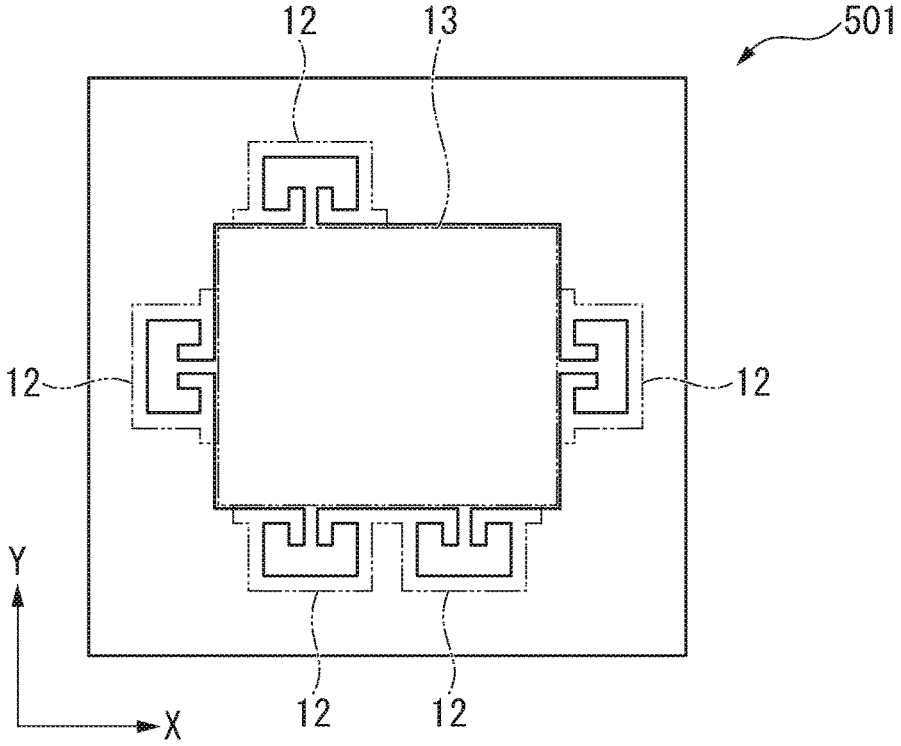
FIG. 16 is a plan view of an example of a conductor according to an aspect of the present disclosure.

FIG. 16 is a plan view of an example of a conductor according to an aspect of the present disclosure.

For example, in a conductor 501, a plurality of split-ring resonators 12 may share an opening 13.

For example, in the conductor 501, five split-ring resonators 12 may be provided as the plurality of the split-ring resonators 12 for one opening 13.

For example, the five split-ring resonators 12 may be provided to surround the opening 13.

Figure 17:
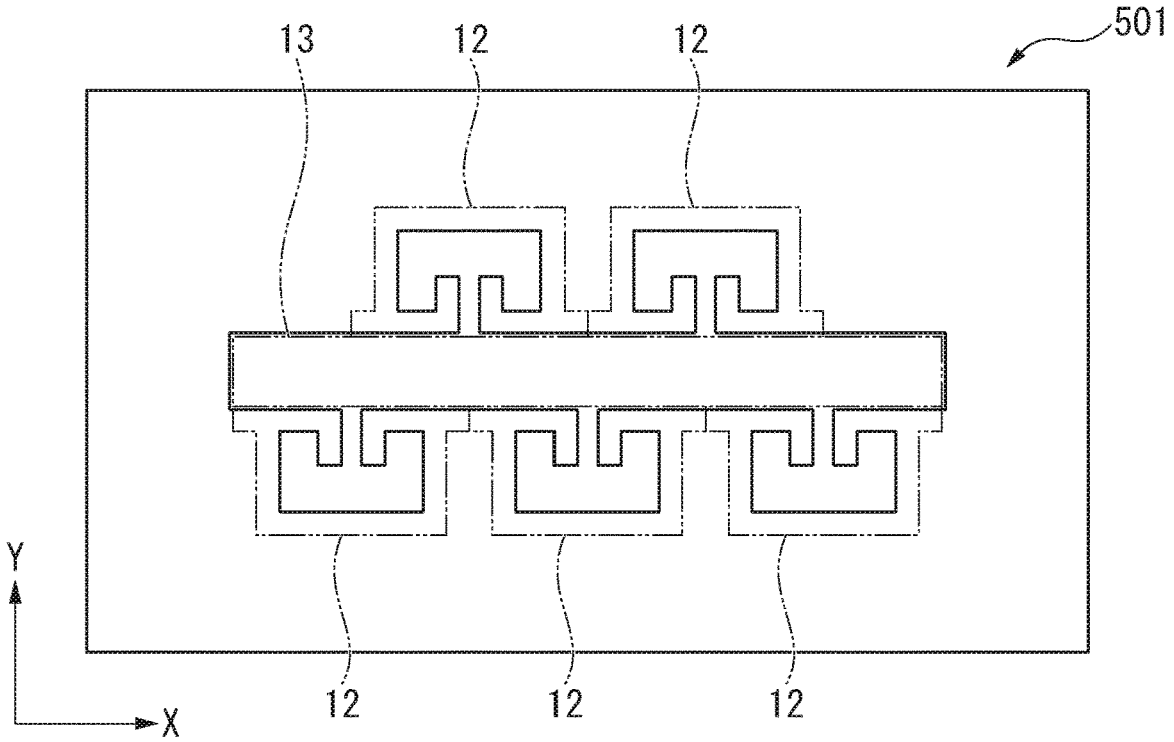
FIG. 17 is a plan view of an example of a conductor according to an aspect of the present disclosure.

FIG. 17 is a plan view of an example of a conductor according to an aspect of the present disclosure.

For example, in a case where an opening 13 has an elongated shape extending long in the X-direction, a plurality of split-ring resonators 12 may be arranged to sandwich the opening 13 from both sides in the Y-direction.

Figure 18:
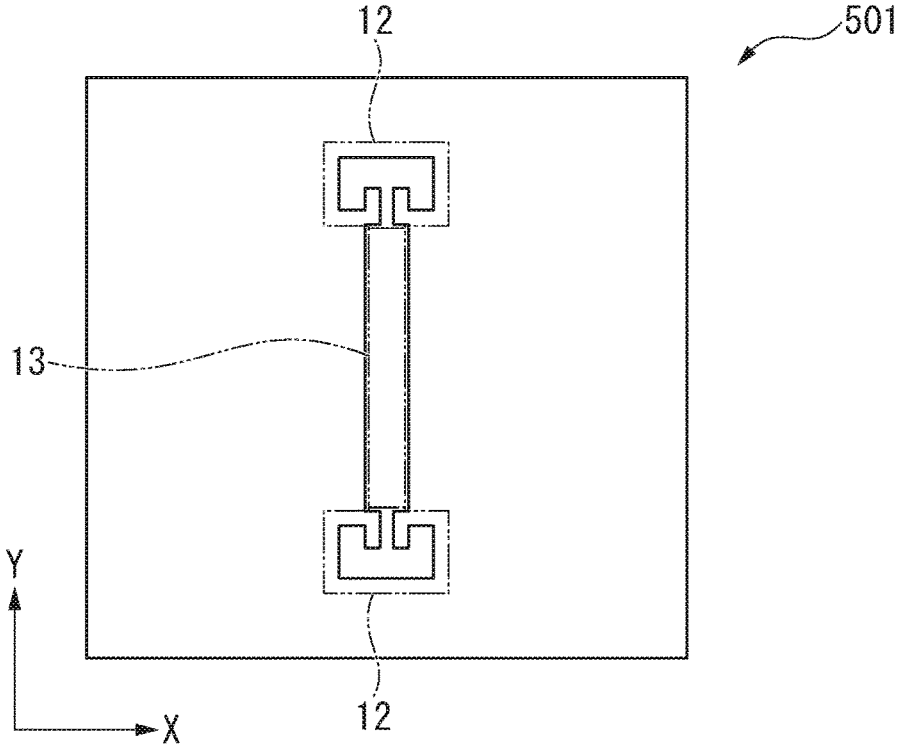
FIG. 18 is a plan view of an example of a conductor according to an aspect of the present disclosure.

FIG. 18 is a plan view of an example of a conductor according to an aspect of the present disclosure.

For example, in a case where an opening 13 has an elongated shape extending long in the Y-direction, a plurality of split-ring resonators 12 may be arranged to sandwich the opening 13 from both sides in the Y-direction.

Figure 19:
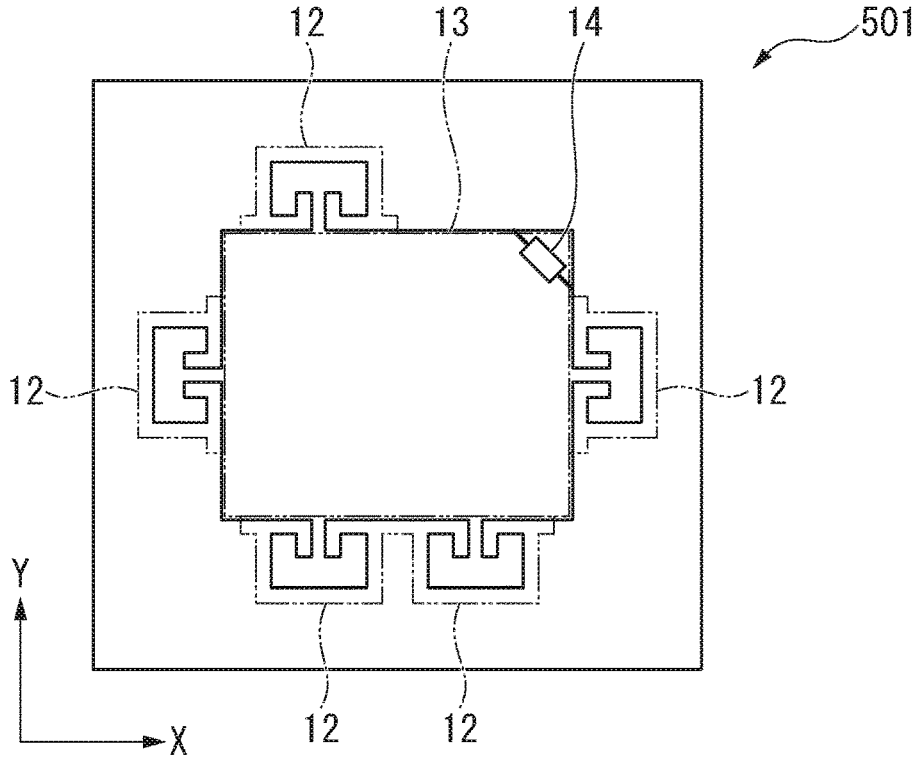
FIG. 19 is a plan view of an example of a conductor according to an aspect of the present disclosure.

FIG. 19 is a plan view of an example of a conductor according to an aspect of the present disclosure.

Figure 20:
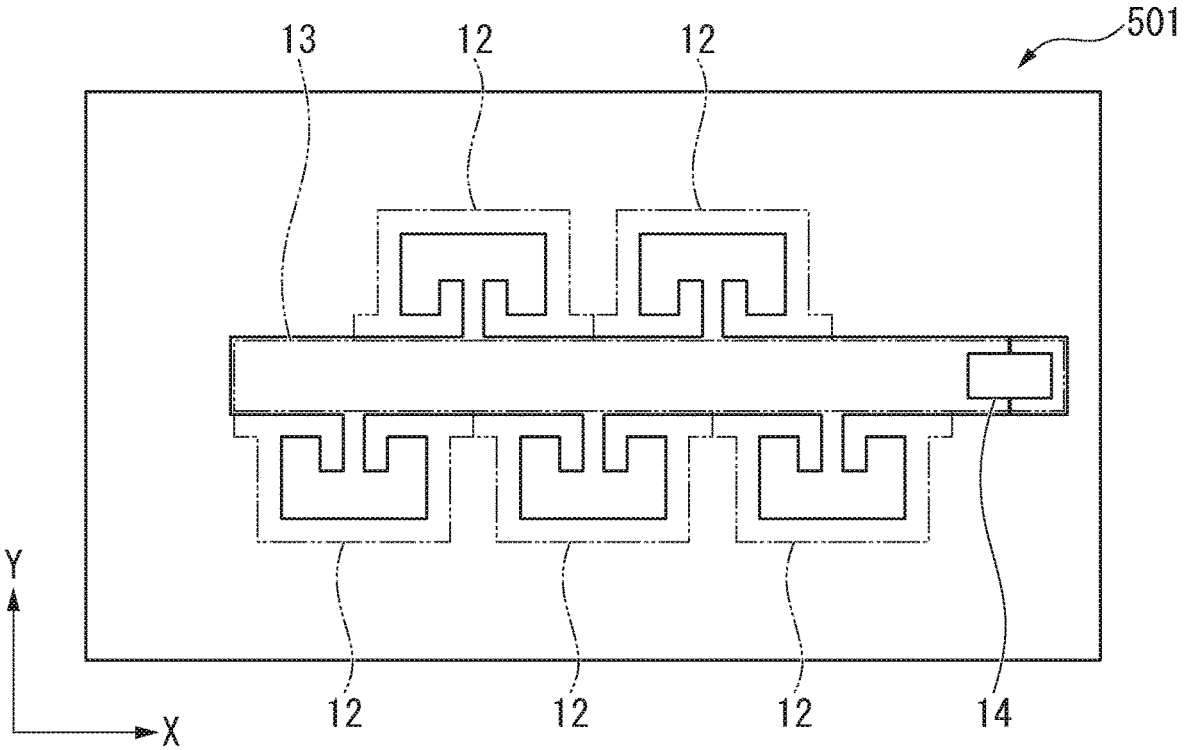
FIG. 20 is a plan view of an example of a conductor according to an aspect of the present disclosure.

FIG. 20 is a plan view of an example of a conductor according to an aspect of the present disclosure.

Figure 21:
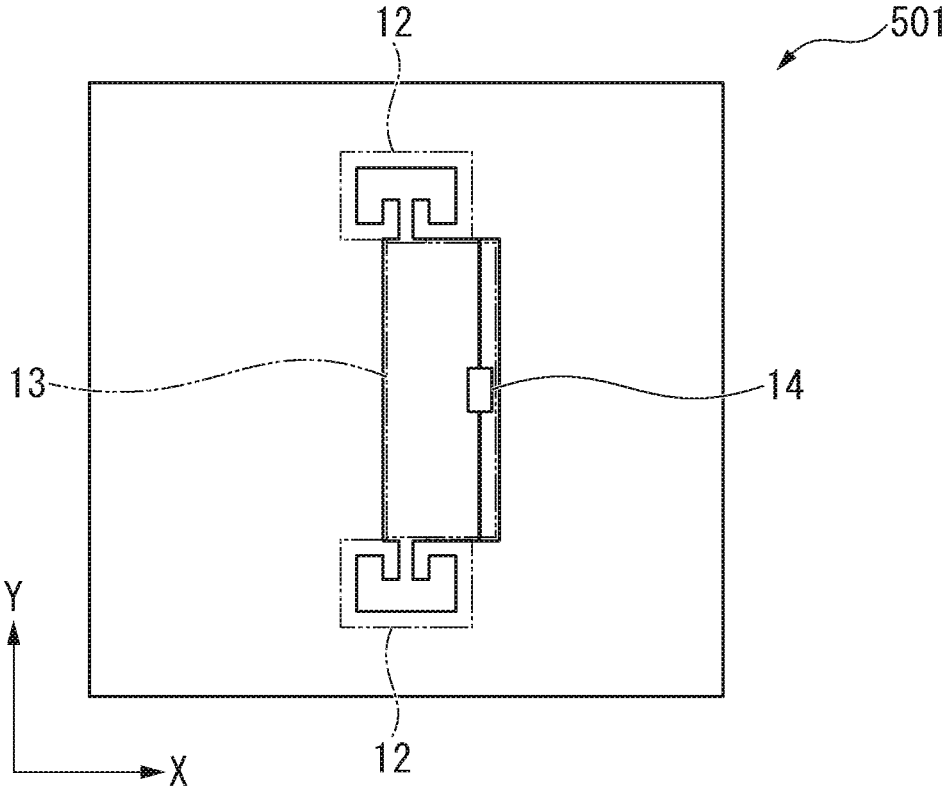
FIG. 21 is a plan view of an example of a conductor according to an aspect of the present disclosure.

FIG. 21 is a plan view of an example of a conductor according to an aspect of the present disclosure.

For example, each of conductors 501 may be further provided with a control unit 14 configured to control a size of an opening 13.

The conductor 501 according to an aspect of the present disclosure is provided with a plurality of split-ring resonators 12.

When the plurality of the split-ring resonators 12 is provided, the opening 13 can be shared by the plurality of the split-ring resonators 12.

Accordingly, an area occupied by the opening 13 in the conductor 501 can be reduced.

Therefore, the conductor 501 is easy to secure a space for putting other parts.

For example, although all of the split-ring resonators 12 share one opening 13 in each of the conductors 501 shown in FIGS. 16 to 21, at least two split-ring resonators 12 among the plurality of the split-ring resonators 12 may share the one opening 13.

For example, a conductor according to disclosure of the present disclosure may be used for an antenna.

For example, an antenna according to an aspect of the present disclosure may be provided with a conductor according to an aspect of the present disclosure (e.g. the conductor 1, the conductor 101, the conductor 201, the conductor 301, the conductor 401, the conductor 501, or the like).

For example, an antenna provided with a conductor according to disclosure of the present disclosure may be used for a communication device.

For example, a communication device according to an aspect of the present disclosure may be provided with an antenna which is provided with a conductor according to an aspect of the present disclosure (e.g. the conductor 1, the conductor 101, the conductor 201, the conductor 301, the conductor 401, the conductor 501, or the like).

Figure 22:
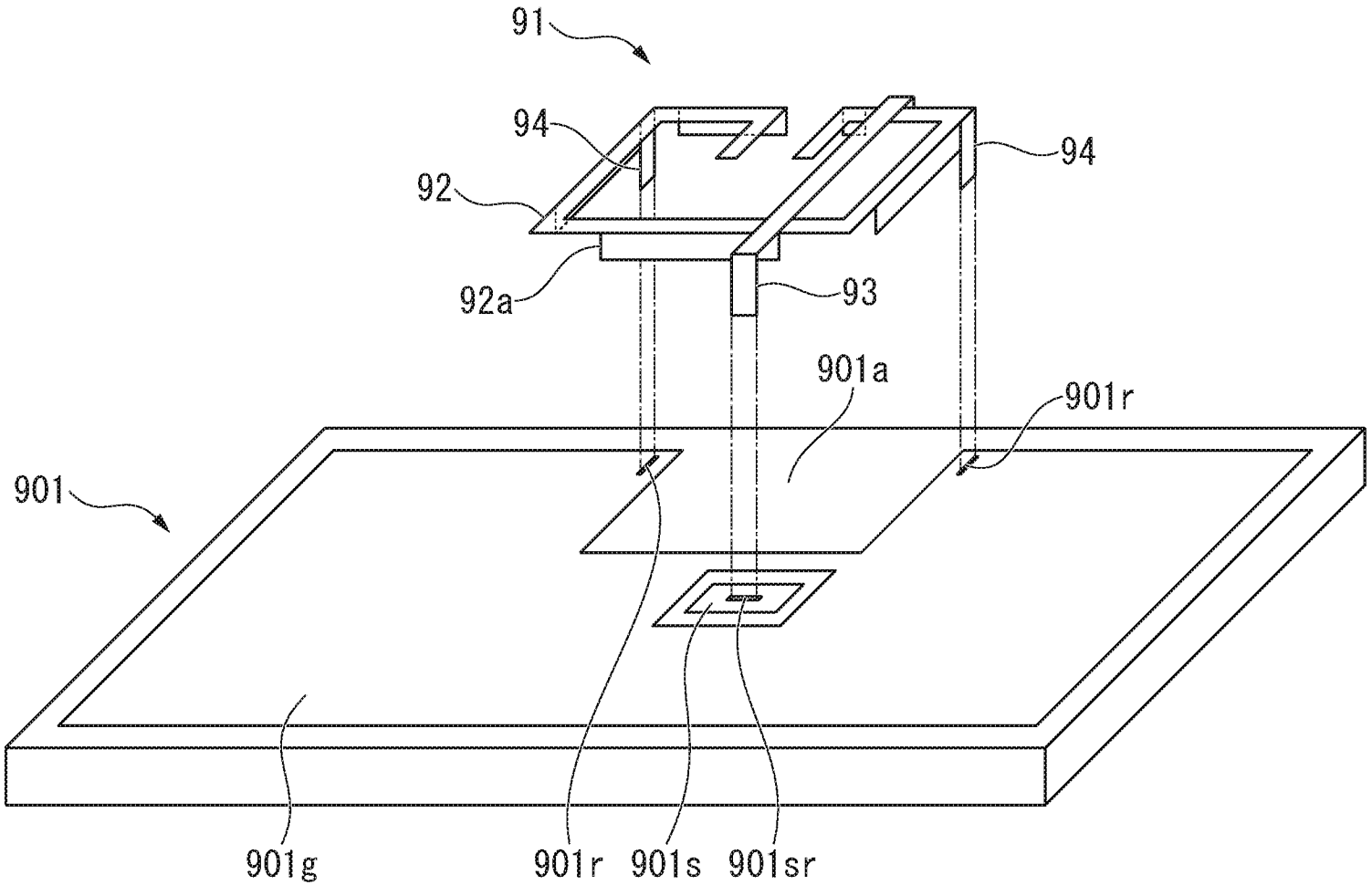
FIG. 22 is an exploded view of a mounting example of a split-ring resonator, which is formed as a component, according to an aspect of the present disclosure.
Figure 23:
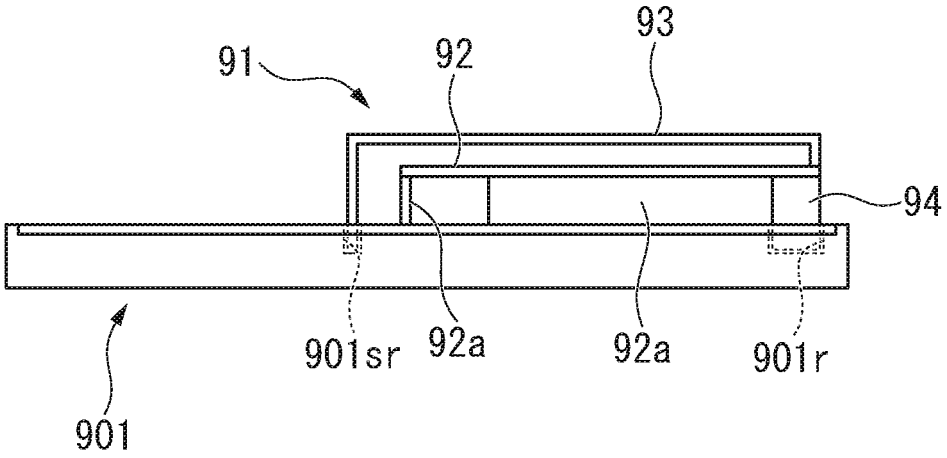
FIG. 23 is a side view of a mounting example of a split-ring resonator, which is formed as a component, according to an aspect of the present disclosure.

FIGS. 22 and 23 are a mounted example of a split-ring resonator, which is made as a part, according to an aspect of the present disclosure.

For example, a split-ring resonator 91 in FIGS. 22 and 23 may be provided with a split-ring portion 92, a feeding terminal 93 and a ground terminal 94.

For example, the split-ring resonator 91 in FIGS. 22 and 23 may be made of a sheet metal as illustrated.

For example, the feeding terminal 93 in FIGS. 22 and 23 may be a terminal for feeding an RF signal to the split-ring portion 92.

For example, the ground terminal 94 in FIGS. 22 and 23 may be separated from a ground pattern 901*g* in a circuit board 901 on which circuit elements, such as a transceiver IC and an amplifier, are mounted.

For example, the circuit board 901 in FIGS. 22 and 23 may be provided with an aperture 901*a* and a reception terminal 901*r*, wherein the aperture 901*a* is formed by cutting the ground pattern 901*g* in accordance with a shape and a size of the split-ring resonator 91, and the reception terminal 901*r* is a terminal connected to the ground terminal 94.

The split-ring resonator 91 in FIGS. 22 and 23 can be handled as a part separated from the circuit board 901 since it is provided with the ground terminal 94, for example.

For example, an antenna may be formed as a whole by accommodating the split-ring resonator 91 in the aperture 901*a* and connecting the ground terminal 94 and the reception terminal 901*r* to each other to electrically connect the split-ring resonator 91 and the ground pattern 901*g* to each other.

For example, as shown in FIGS. 22 and 23, regarding each of the reception terminal 901*r* and the ground terminal 94, the reception terminal 901*r* may be a hole formed in the circuit board, and the ground terminal 94 may have a shape insertable into the reception terminal 901*r* which is the hole.

For example, when the ground terminal 94 is inserted into and connected to the reception terminal 901*r*, they are electrically connected and fixed to each other through something, such as solder.

For example, as shown in FIGS. 22 and 23, a part of the split-ring portion 92 may be provided with a support 92*a* which is bent toward the circuit board 901 and extends. Owing to the support 92*a*, the split-ring resonator 91 keeps a balance with a surface of the circuit board 901 with a predetermined gap left therebetween, so that influence of the circuit board on characteristics of the split-ring resonator can be reduced. Moreover, the support 92*a* may be electrically connected to the ground pattern 901*g* or may not be.

For example, as shown in FIGS. 22 and 23, the feeding terminal 93 may be also inserted in a reception terminal 901*sr*, which is formed in the circuit board as a hole, and connected to the reception terminal 901*sr*. In this time, the reception terminal 901*sr* is formed in a region of the feeding pattern 901*s* on the circuit board. When the feeding terminal 93 and the reception terminal 901*sr* are connected to each other, the feeding terminal 93 and the feeding pattern 901*s* are electrically connected to and fixed to each other with something, such as a solder.

The present application is based on a Japanese patent application of JP2018-087690 filed on Apr. 27, 2018 before the Japan Patent Office, the content of which is entirely incorporated herein.

REFERENCE SIGNS LIST

1 conductor
10 conductor
101 conductor
201 conductor
301 conductor
401 conductor
501 conductor
12 split-ring resonator
121 split
122 split-ring
1221 first conductor
1222 second conductor
1223 third conductor
1224 fourth conductor
123 ring-inner opening
13 opening
14 control unit
141 switch
2 feeder
21 via
3 substrate
4 connector
41 peripheral conductor
42 internal axis conductor
L1 first layer
L2 second layer
L3 third layer
I1 current
I2 current
fo frequency
C point
L straight-line
M straight-line
m line segment
D cylindrical axis direction
a curve
b curve

91 split-ring resonator
92 split-ring portion
92*a* support
93 feeding terminal
94 ground terminal
901 circuit board
901*a* aperture
901*g* ground pattern
901*r* terminal
901*s* feeding pattern
901*sr* terminal

The invention claimed is:

1. A conductor comprising a split ring resonator, an opening, and a controller, wherein a split in the split ring resonator and the opening are spatially continuous to each other, and wherein the controller is configured to control a size of the opening.

2. A conductor comprising a split ring resonator and an opening having an elongated shape, wherein a split in the split ring resonator and the opening are spatially continuous to each other, and wherein a length of the opening in a direction substantially parallel to a tangential line between the split ring resonator and the opening is different from a length of the opening in a direction substantially perpendicular to the tangential line between the split ring resonator and the opening.

3. The conductor as recited in claim 1, wherein the conductor comprises a plurality of the split ring resonators.

4. An antenna comprising the conductor as recited in claim 1.

5. A communication device comprising the antenna as recited in claim 4.

6. The conductor as recited in claim 2, wherein the conductor comprises a plurality of the split ring resonators.

7. An antenna comprising the conductor as recited in claim 1.

8. A communication device comprising the antenna as recited in claim 7.

* * * * *